United States Patent [19]

Yoshikawa et al.

[11] 4,085,675

[45] Apr. 25, 1978

[54] AUTOMATIC ELECTRICAL CREDIT-CARD IMPRINTER

[75] Inventors: Naohiro Yoshikawa, Itabashi; Sadaharu Sato, Kodaira; Masanori Matsubara, Futususa; Masao Hosoda Higashiyamto, all of Japan

[73] Assignee: Janome Sewing Machine Co. Ltd., Tokyo, Japan

[21] Appl. No.: 748,621

[22] Filed: Nov. 29, 1976

[30] Foreign Application Priority Data

Dec. 2, 1975 Japan ..... 50-144375

[51] Int. Cl.[2] ..... A41F 3/04

[52] U.S. Cl. ..... 101/269

[58] Field of Search ..... 101/45, 56, 269–274, 101/382 MV, 287, 316

[56] References Cited

U.S. PATENT DOCUMENTS

| | | | |
|---|---|---|---|
| 3,402,662 | 9/1968 | Blair et al. | 101/45 X |
| 3,420,171 | 1/1969 | Mavl et al. | 101/269 |
| 3,572,242 | 3/1977 | Friend | 101/269 |
| 3,626,463 | 12/1971 | Foerster | 101/45 X |
| 3,800,700 | 4/1974 | McInnis et al. | 101/269 |

*Primary Examiner*—Edward M. Coven
*Attorney, Agent, or Firm*—Michael J. Striker

[57] ABSTRACT

An apparatus for imprinting the raised indicia from a credit card on a copy sheet has a support provided with a holder for the credit card. A printing head is movable on the support between a raised position spaced from the holder and a lowered position juxtaposed therewith. In this lowered position an electrical actuator in the head can roll a platen roller across the card to imprint indicia on the card on a copy sheet overlying the card. An electromagnet in the support holds the head in the lowered position during the printing cycle. Switches are provided to energize the actuator once the head is fully in the lowered position and to deenergize the holding electromagnet after the printing cycle is completed so that the head can return to the raised position.

12 Claims, 4 Drawing Figures

F
PL
MG
S
A
Cd
a

AUTOMATIC ELECTRICAL CREDIT-CARD IMPRINTER

BACKGROUND OF THE INVENTION:

The present invention relates to an imprinting apparatus. More particularly this invention concerns an automatic device for printing the information from a master such as a credit card onto a copy sheet.

When a credit-card sale is made the buyer's credit card is fitted into a holder of an imprinting apparatus. This credit card carries raised indicia normally giving the name and account number of the buyer. The imprinter carries a plate which further gives the name and account number of the seller, and wheels or variable indicators on the imprinter also indicate the date of the sale and the sale price. Thus the credit card is placed in the holder and the machine is set for the particular sale price. Then a copy sheet, normally a multi-sheet billing form, is positioned on top of the master constituted by the indicia on the credit card and on the imprinting apparatus. A roller is then displaced across the billing slip, pressing it firmly down onto the underlying master so that the raised indicia on this master is all imprinted on the billing form.

Such a device allows credit sales to be carried out with some speed, at the same time insuring that all of the necessary information is transmitted to the multi-copy billing form. Such devices have several disadvantages however. First of all it is essential that an exactly controlled and relatively even pressure be applied to the copy sheet lying on top of the master. If the pressure is too great the copy sheet can be damaged. These copy sheets normally carry their own serial numbers so it is necessary to account for every one of them, so that such damage requires voiding an entry of the unusable billing form. Furthermore, if the pressure is too light the information will not be transferred accurately to all of the copies of the form, so that inaccurate billing can result or the loss of information can result in either the seller or the credit agency working with the seller losing the credit altogether.

Furthermore such devices frequently are relatively hard to operate, being heavily loaded with springs and the like so that the user must exert considerable force in order to pass the roller over the copy sheet lying on the master. When a great many transactions are being carried out this can result in a considerable tiring of the user, so that uneven printing results are obtained. Furthermore a handicapped person or a person of modest strength sometimes has difficulty operating such an imprinter.

SUMMARY OF THE INVENTION

It is therefore an object to provide an improved imprinter.

Another object is the provision of an improved apparatus of the above-described general type which overcomes the above-given disadvantages.

Another object is to provide an imprinter which, in addition to being usable with credit cards and billing slips as described above, can be also used in other imprinting areas where information must be transferred from a master to a copy sheet.

These objects are attained according to the present invention in an apparatus of the above-described general type having a support provided with a holder for the master, a printing head movable on the support between an inoperative position spaced from the holder and an operative position closely juxtaposed with the holder. A roller is displaceable on this printing head by an electrical actuator between a pair of roller end positions. Thus when the actuator moves the roller in the operative position of the head between the end positions the roller rolls over a copy sheet lying on the master and imprints indicia from the master onto the copy sheet. An electromagnet is provided either on the head or on the support which coacts with a ferromagnetic block or element on the support or head, respectively, so as to hold the head in the operative position during displacement of the roller by the electrical actuator from one of the end positions of the roller into the other end position.

In accordance with further features of this invention electrical circuitry is provided which insures that once the head is pivoted from the inoperative position into the operative position the electromagnet automatically locks the head to the support and the electrical actuator automatically moves the roller across the copy sheet on top of the indicia, and once this printing cycle is completed the electromagnet is deenergized and the head is swung back up into the inoperative position. Thus in accordance with this invention the user need merely close the head down onto the support and then allow the automatic mechanism of the device to carry out all of the remaining steps of the printing operation. Since the apparatus does therefore not require the user to supply the actuating force, it is possible to control the pressure which the roller exerts on the printing sheet as well as all of the operating parameters within very close limits, thereby obtaining very regular results.

According to yet another feature of this invention the electrical control means comprises at least three switches. All three switches are of the normally closed type and may be of microswitch construction. One of these switches is a head-position switch, mounted on the head and moved into its open-circuit position only in the inoperative or up position of the head. Another switch is a roller-position switch which is moved from its closed position into its open position only when the roller is moved by the actuator against the force of a spring from its end starting position into its opposite end position. The head-position switch is connected on one side through an on-off switch to a source of electricity, such as a line plug, and on its other side is connected to this roller position switch. The third switch is an actuating switch also provided on the imprinter head between this head and an actuating lever or member which is formed as a handle by means of which the head is swung from the inoperative to the operative position. This actuating switch is moved from its normally closed position to its open-circuit position whenever the actuating member is depressed. Furthermore this actuating switch is connected on one side to the head-position switch and on the other side to the electrical actuator. The roller-position switch is connected on one side to the head-position switch and on the other side to the electromagnet mounted in the support or base of the imprinter. With the system described above, therefore, the user depresses the actuating lever so as to bring the head out of the inoperative position. This closes the head-position switch and, since the roller is not in its end position actuating the roller-position switch, the electromagnet is immediately energized through the series-connected head-position switch and roller-position switch. In this manner the user brings the head down into the operative position where the electromagnet holds it firmly in place. When the actuating lever is then released, therefore, the actuating switch itself will move back to its closed-circuit position and form a closed circuit between the electrical actuator and the now closed head-position switch. The electrical actuator will therefore move the roller across the copy sheet to print the information from the master onto the copy sheet. Once the roller moves to its back end position, however, it actuates the roller-position switch to open-circuit the electromagnet, causing the head to swing back into the inoperative position either due to its own weight, or as a result of a spring normally urging it into this position. Once the head is back in the inoperative position the head-position switch will be actuated so as to open-circuit both the actuator and the electromagnet.

The system described immediately above is particularly useful when a solenoid constitutes the actuator. In accordance with this invention it is possible also to use a rotary electrical motor as the actuator. In this situation another roller-position switch is employed which is connected in shunt across both the actuating switch and the head-position switch. This second roller-position switch is only open when the roller is in its front end position. Thus when the motor is connected via a crank arrangement to the roller the device will function substantially as described above, but the motor will continue to operate, even with the head in the inoperative position, until the roller has been returned by the rotary motor to its starting position.

With the systems described above the force necessary to move the actuating member for the actuating switch is smaller than the force necessary to move the head out of the inoperative position. Thus when the actuating member is depressed the actuating switch will be opened before the head moves out of the inoperative position to close the head-position switch.

In accordance with yet another feature of this invention the electromagnet, which as described above is provided on the bed of the apparatus, is biased downwardly away from the head by means of a spring, so that once the electromagnet locks onto the ferromagnetic block carried on the head, the force with which the roller is pressed down against the master is exactly determined by this spring pressure. Thus absolutely even and adjustable results can readily be obtained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2:
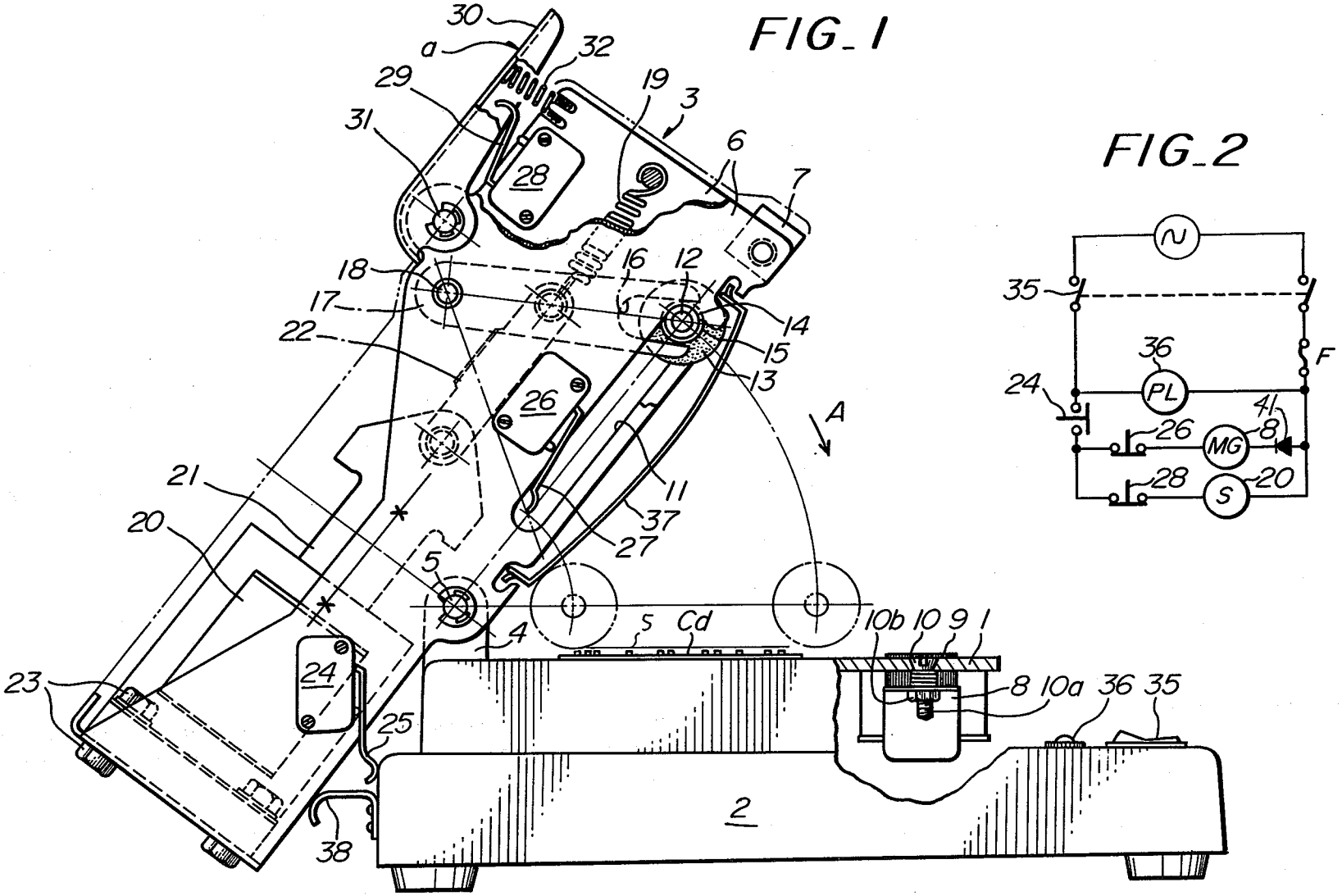
FIG. 1 is a side view partly in section showing an embodiment of the imprinter according to this invention.
FIG. 2 is a schematic diagram illustrating the circuit of the apparatus of FIG. 1.

As shown in FIG. 1, a substantially rectangular printing bed 1 is fixedly mounted on an imprinter base 2. On the upper surface of the printing bed there are arranged printing plates such as a credit card *Cd*, a name plate, a variable date plate, etc., in the respectively determined positions although only a credit card *Cd* is illustrated. A printing head 3 is pivotally mounted on a shaft 5 which is supported on mounting lug 4 formed on the upper part of the base 2 at the back thereof. Thus the printing head 3 can be moved between a lowered operative position for the printing operation in which a platen roller 13 is lowered as illustrated in an imaginary line in FIG. 1 and a raised released inoperative position shown in solid lines. The printing head 3 may be displaced into the inoperative position by making the rear portion of the head 3 heavier than the front portion or by providing a suitable torsion spring. The shaft 5 may be eccentric with respect to the mount 4 so as to adjust the position of the printing head 3 relative to the base 2.

Frames 6 on both sides of the printing head 3 carry the printing head 3 on the shaft 5. On the lower part of the frame 6 at the front thereof, a ferromagnetic metal piece 7 is arranged in a manner so as to be vertically adjustable and can be attracted by an electromagnet 8 when the printing head 3 is brought to the lowered operative position. The electromagnet 8 which can attract the metal piece and accordingly the printing head 3 is secured under the printing bed 1 at the front end thereof by means of a bolt 10*a* and a nut 10*b* with a coil spring 10 positioned between the underside of the printing bed 1 and the electromagnet 8 itself so that the pole formed by the upper face 9 of the electromagnet 8 is positioned slightly above the upper surface of the printing bed 1. The electromagnet 8 is energized through a rectifier 41. The coil spring 10 establishes a printing pressure as will be described hereinafter.

A pair of lateral slots or groove 11 each formed in a respective frame 6 of the printing head 3 extend parallel to each other through the same distance in the front part of the frames at the lower regions thereof for guiding a roller platen 13. The roller platen 13 has a central axle 12 provided on each end with an inner bearing 14 and an outer bearing 15. The outer bearing 15 of the platen roller 13 engages the respective guide grooves 11. A forked frame 17 is provided at the upper part of the head 3, pivotal on the frames 6 by means of a support pin 18 which extends transversely of the frames 6 at the upper part thereof parallel to the roller 13. The forked frame 17 has a pair of lower forked ends 16 slidably engaging the inner bearings 14 of the roller platen 13. The forked frame 17 is biased in the counterclockwise direction by a tension spring 19, one end of which is connected to the forked frame 17 and the other end anchored to the frame 6 for returning the roller platen 13 to the starting position at the front of the head 3 after the printing operation has been finished.

An electromagnetic apparatus or a solenoid 20 is fixedly mounted in the rear of the printing head 3 by means of bolts and nuts 23. The solenoid 20 is provided with an armature or plunger 21 which is connected to the forked frame 17 by a link 22. Thus when the solenoid 20 is energized the plunger 21 is pulled back to turn the forked frame 17 clockwise and to move the roller platen 13 from the starting position at the front ends of slots 11 to the end position at the rear of the guide grooves 11. A normally opened microswitch 24 has an actuator 25 and is provided at the rear of the frame 6 on the outside thereof. When the printing head 3 is positioned in the released inoperative position as shown, the actuator 25 of the microswitch 24 is pressed against the rear end of the base 2 and as shown in FIG. 2 opens the electric circuit for the solenoid 20 and for the electromagnet 8.

A normally closed microswitch 26 has an actuator 27 and is provided at the front of the frame 6 on the outside thereof. The microswitch 26 as shown in FIG. 2 can open the electric circuit for the electromagnet 8 when the roller platen 13 pushes up the actuator 27 of the microswitch 26 after it is moved to the rear end of the guide grooves 11 from the starting position. A further normally closed microswitch 28 has an actuator 29 and is provided in the upper and front end part of the printing head 3. The switch 28 is in series with the solenoid 20 and its actuator 29 is positioned beneath an operating handle 30 which is pivotally mounted on the upper portion of the frames 6 adjacent the microswitch 28 by means of a pivot pin 31. The operating handle 30 is biased upwardly by means of a spring which is provided between the underside of the handle 30 and the upper end of the frame 6. Thus the underside of the handle 30 is normally spaced from the actuator 29 of the microswitch 28. These electrical connections are all shown in FIG. 2. At the lower side of the printing head 3, an elongated elastic plate 37 is detachably mounted and is bent slightly downwardly so as to hold a printed sheet 5 on the printing bed 1 when the printing head 3 is brought to the lowered operative position. A power switch 35 and a pilot lamp 36 are provided on the upper face of the imprinter base 2.

Figure 4:
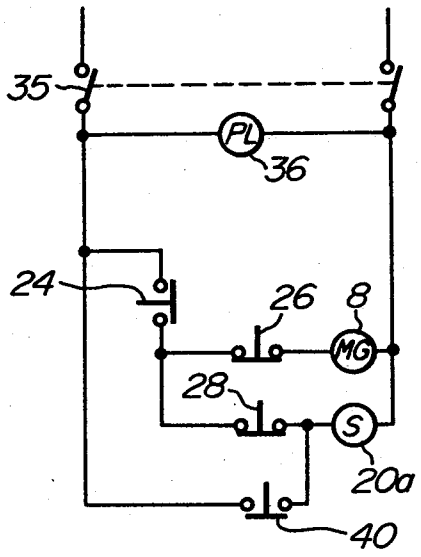
FIG. 4 is a schematic circuit diagram for the apparatus of FIG. 3.
Figure 3:
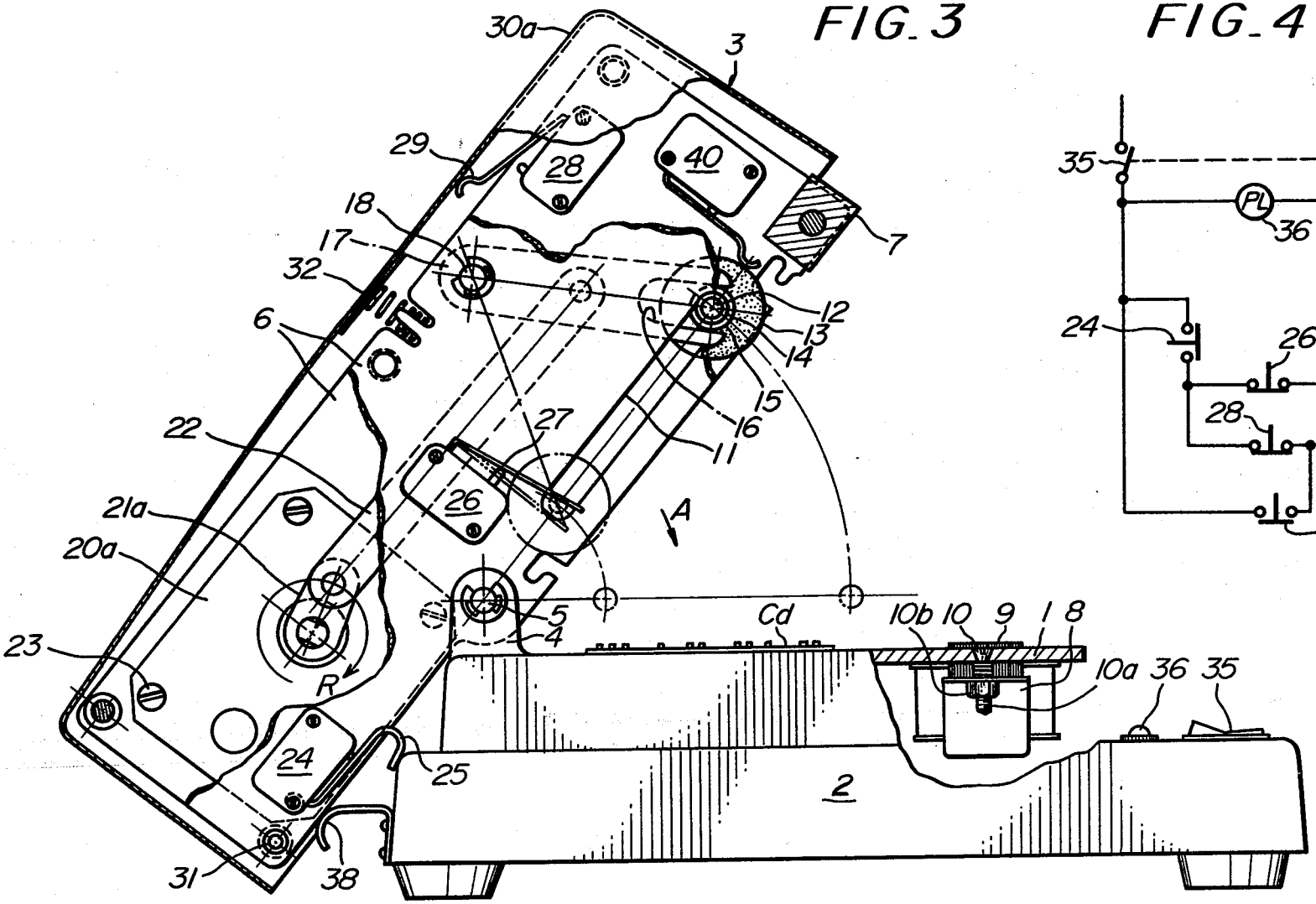
FIG. 3 is a view similar to FIG. 1 illustrating another embodiment of the imprinter according to this invention.

FIGS. 3 and 4 show another embodiment of the invention which is different from the first embodiment in the following points: An electric motor **20*a* is provided with a speed reducing transmission which is connected to the forked frame 17 by means of a crank arm 21*a* and a connecting link 22. When the crank arm is turned in the direction R at a suitable speed the forked frame 17 is pivoted in the clockwise direction and the roller platen 13 is moved along the guide grooves 11** to the dot-dash end position from the solid-line starting position.

An additional microswitch 40 is provided at the front end of the frame 6 or the outer side thereof. The microswitch 40 is normally closed and operates to open the electric circuit (FIG. 4) of the electric motor **20*a* only when the roller 13 is in the starting position. The operating cover 30*a* is pivoted at its lower end thereof on the frames 6. As in the first embodiment, the operating cover 30*a* engages the actuator 29 of the microswitch 28 only when it is pressed down against the action of the spring 32. The microswitches and the associated parts of the embodiment are connected to each other as illustrated in FIG. 4**.

In these embodiments of the invention, the gravity center is in the rear of the printing head 3 behind the support shaft 5, or a suitable releasing spring is provided in order to automatically turn the printing head 3 into the inoperative position from the lower operative position whenever the electromagnet 8 becomes ineffective. In this connection, the spring 32 is of a force smaller than the force necessary to move the printing head 3 down into the operative position so that the switch 28 opens on depression of the cover **30*a* before the head 3** starts to pivot.

The apparatus functions as follows:

First the power source switch 35 is closed and a credit card C*d* and other necessary printing plates are placed in the determined positions on the printing bed 1 and the variable date wheels are set. Then a printing form or a printing sheet S is placed on the printing bed over the card C*d*. In FIGS. 1 and 2 when the operating handle 30 is manually pressed down to turn the printing head 3 in the direction indicated by arrow A, the microswitch 28 is opened, and then the microswitch 24 is closed as the actuator 25 of the microswitch 24 pulls away from the base 2. Therefore, the solenoid 20 is not energized, but the electromagnet 8 is energized. As the printing head 3 pivots further in the direction indicated by arrow A the metal piece on the printing head is attracted by the electromagnet 8 with a strong force, and the printing form S of a certain thickness is clamped tightly between the roller platen 13 and the printing bed 1.

When the operator then releases the operating handle 30, the microswitch 28 closes and the solenoid 20 is energized so as to pull the plunger 21 backwardly and move the roller platen 13 along the guide grooves 11 so that it rolls across the printing form and the printing plates or the printing bed to the rear end of the guide grooves from the opposite starting position, printing the card, date and other information on the sheet 5. When the roller platen 13 comes to the rear end of the guide grooves 11, the actuator 27 of the microswitch 26 is pressed up by the other bearing 14 and the microswitch 26 is opened. Accordingly the electromagnet 8 is deenergized. The printing head 3 is therefore turned in the counterclockwise direction to the upper inoperative position by the offset center of gravity of the printing head or the releasing spring. This opens the microswitch 24 and deenergizes the solenoid 20.

As described above, the solenoid 20 is energized and holds the roller platen 13 in the rear end of the guide grooves 11 until the microswitch 24 opens. The solenoid 20 is deenergized when the microswitch 24 opens as the actuator 25 engages and is depressed by the rear end of the base 2 at the end of the counterclockwise turning movement of the printing head 3. The roller platen 13 therefore is returned to the starting position at the front end of the guide grooves 11 by the return spring 19 and then the printing head 3 is stopped at the upper inoperative position by the stopper spring 38 which is fixed on the rear end of the base 2 and engages the rear end of the printing head. Thus one cycle of the printing operation is finished.

In the second embodiment in FIGS. 3 and 4, when the printing head 3 is manually pressed down, the microswitch 28 is opened, the microswitch 24 is closed, and the electromagnet 8 is energized. As the printing head is further pressed down the metal piece 7 on the printing head is attracted by the electromagnet 8 with a strong force. Thereupon when the operator releases the operating cover 30, the microswitch 28 closes and the electric motor **20*a* is energized so that its crank arm 21*a* rotates in direction R and the roller platen 13 is moved to the opposite end of the guide grooves 11 from the starting position at the front end of the grooves 11 so that the roller platen 13 closes the microswitch 40. Thus the printing form is printed while the microswitch 40 is closed. When the roller platen 13 opens the microswitch 26 the electromagnet 8 is deenergized so that the printing head 3 can start to move to the upper inoperative position. Since, however, the electric motor 20*a* is still energized the crank arm 21*a* continues to rotate until the roller platen 13 is moved back to the front end of the guide grooves 11 where the roller platen 13 opens the microswitch 40. Thus just before the printing head 3 comes to the upper inoperative position, the microswitches 40 and 24 are opened, and the electric motor 20***a* and the electromagnet 8 are deenergized. In this manner, one complete cycle of the printing operation is finished.

In this invention, a suitable printing pressure is obtained by the coil spring 10 fitted between the underside of the printing bed 1 and the electromagnet 8. If a printing form of a predetermined thickness is placed on the printing bed and the printing head 3 is brought to the lower operative position, the printing head 3 is pushed. However, as the printing head is attracted by the electromagnet 8 via the metal piece 7, the coil spring 10 is further compressed to maintain the necessary printing pressure. The compression of the coil spring 10 can be adjusted by tightening or loosening the nut 10*a*. Further, adjustment of the eccentric shaft 5 of the printing head can vary the printing effect by vertically displacing the shaft 5 relative to the base so that the path of travel of the shaft 12 is parallel to the bed 1.

It will be understood that each of the elements described above, or two or more together, may also find a useful application in other types of imprinters differing from the types described above.

While the invention has been illustrated and described as embodied in an imprinter for a credit card, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for imprinting indicia from a master on a copy sheet, said apparatus comprising:

a support having a holder for said master;

a printing head movable on said support between an inoperative position spaced from said holder and an operative position closely juxtaposed with said holder;

a roller displaceable on said printing head between a pair of roller end positions and engageable in said operative position of said head through a copy sheet lying on a master in said holder with said master;

means including an electromagnetic element and having a ferromagnetic element for holding said head in said operative position, one of said elements being on said head and the other element being on said support;

means including a switch between said head and said roller, connected in circuit with said electromagnetic element, and displaceable between a closed position corresponding to one end position of said roller for energization of said electromagnetic element and an open position corresponding to the other end position of said roller for deenergization of said electromagnetic element;

means in said head including an electrical actuator electrically energizable to move said roller from said one end position into said other end position;

a spring urging said roller into said one end position;

an operating member on said head; and a switch connected between said operating member and said head and connected in circuit with said actuator for deenergizing same on actuation of said operating member.

2. The apparatus defined in claim 1, wherein said actuator is a solenoid in said head.

3. The apparatus defined in claim 1, wherein said actuator is an electrical motor in said head having a crank operatively connected to said roller, said apparatus further comprising a switch means for connecting said motor to a source of electricity in all but said one end position of said roller.

4. The apparatus defined in claim 1, wherein said switch connected between said member and said head is a normally closed switch, said apparatus further comprising a switch between said head and said support which is in series with said normally closed switch and opens only in said inoperative position of said head, whereby said actuator can only be energized when said operating member is unactuated and said head is out of said inoperative position.

5. The apparatus defined in claim 4; further comprising another switch in said head and connected in parallel across said normally closed switch between said operating member and said head and said switch in series therewith, said other switch being open only when said roller is in said one end position.

6. The apparatus defined in claim 5, wherein said actuator is a rotary electrical motor having a crank operatively connected to said roller.

7. The apparatus defined in claim 1, wherein said electromagnetic element is carried on said support and is displaceable thereon between a raised position and a lowered position, said apparatus further comprising adjustable spring means for urging said electromagnetic element into said lowered position with an adjustable force.

8. An apparatus for imprinting indicia from a master on a copy sheet, said apparatus comprising:

a support having a holder for said master;

a printing head movable on said support between an inoperative position spaced from said holder and an operative position closely juxtaposed with said holder;

a roller displaceable on said printing head between a pair of roller end positions and engageable in said inoperative position of said head through a copy lying on a master in said holder with said master, said head being provided with a straight guide along which said roller is displaceable in a straight line between said end positions;

means including an electromagnetic element and having a ferromagnetic element for holding said head in said operative position, one of said elements being on said head and the other element being on said support;

means including a switch between said head and said roller, connected in circuit with said electromagnetic element, and displaceable between a closed position corresponding to one end position of said roller for energization of said electromagnetic element and an open position corresponding to the other end position of said roller for deenergization of said electromagnetic element;

means in said head including an electrical actuator electrically energizable to move said roller from said one end position into said other end position; and a spring urging said roller into said one end position.

9. An apparatus for imprinting indicia from a master on a copy sheet, said apparatus comprising:

a support having a holder for said master;

a printing head movable on said support between an inoperative position spaced from said holder and an operative position closely juxtaposed with said holder;

a roller displaceable on said printing head between a pair of roller end positions and engageable in said operative position of said head through a copy sheet lying on a master in said holder with said master;

means in said head for displacing said roller between said end positions in said operative position of said head thereby rolling said roller over a copy sheet on said master and imprinting indicia from said master on the copy sheet lying thereon, said means for displacing said roller including an electrical actuator electrically energizable to displace said roller from one of said end positions into the other end position;

means including an electromagnetic element and having a ferromagnetic element for holding said head in said operative position, one of said elements being on said head and the other element being on said support;

electrical control means connectable to a source of electricity and including a head-position switch between said head and said support and connected to said source, said head-position switch being displaceable from an open-circuit position to a closed position only on displacement of said head from said inoperative position;

an actuating switch on said head connected in series between said head-position switch and said actuator and displaceable from an unactuated closed-circuit position connecting said actuator to said head-position switch to an actuated open-circuit position electrically isolating said actuator from said head-position switch; and a roller position switch connected between said head-position switch and said electromagnetic element and displaceable from a closed-circuit position electrically connecting said electromagnetic element to said head-position switch only in one end position of said roller to an open-circuit position electrically isolating said electromagnetic element from said head-position switch when said roller is out of said one end position.

10. The apparatus defined in claim 9, wherein said head is provided with an actuating element connected to said actuating switch and manually operable on displacement of said head out of said inoperative position to displace said actuating switch into said actuated position.

11. The apparatus defined in claim 10, wherein said actuator is an electrical motor having a crank operatively connected to said roller, and said electrical control means further includes another roller end switch connected in parallel across said actuating and head-position switches and displaceable from an open-circuit position only in the other end position of said roller to a closed-circuit position when said roller is out of said other end position for connection of said actuator to said source in a shunt past said head-position and actuating switches except when said roller is in said other end position.

12. The apparatus defined in claim 9, wherein said head is so constructed and arranged as to be biased with a predetermined force into said inoperative position, said apparatus further comprising means for biasing said actuating switch into said unactuated position with a force smaller than said predetermined force.

* * * * *